US006168247B1

(12) United States Patent
Stahmer et al.

(10) Patent No.: US 6,168,247 B1
(45) Date of Patent: Jan. 2, 2001

(54) FILE DRAWER RAIL

(75) Inventors: Ulf Stahmer; Christine Dominik; Geoffrey Milligan, all of Toronto; Lorie Marangoni, Weston, all of (CA)

(73) Assignee: Teknion Furniture Systems Limited, Toronto (CA)

( * ) Notice: Under 35 U.S.C. 154(b), the term of this patent shall be extended for 0 days.

(21) Appl. No.: 09/335,839

(22) Filed: Jun. 18, 1999

(30) Foreign Application Priority Data

Jun. 9, 1999 (CA) ..... 2273796

(51) Int. Cl.[7] ..... B42F 15/00
(52) U.S. Cl. ..... 312/183; 24/67.9; 312/184
(58) Field of Search ..... 24/67.9, 545, 563; 220/529, 534, 544, 545; 312/183, 184, 193, 348.7

(56) References Cited

U.S. PATENT DOCUMENTS 3,748,008 * 7/1973 Pryor ..... 312/184
5,393,136 * 2/1995 Grabowski et al. ..... 312/193 X
5,910,351 * 6/1999 Davis et al. ..... 24/67.9 X

* cited by examiner

*Primary Examiner*—Jose V. Chen
*Assistant Examiner*—Michael J. Fisher
(74) *Attorney, Agent, or Firm*—Bereskin & Parr

(57) ABSTRACT

A file drawer is disclosed where two opposed top edges of the file drawer include pivoting rails which are movable to one of the two positions. The rails in one position are spaced for supporting letter size file jackets and in the other position support metric A4 size file jackets. This arrangement allows the manufacture of common size file drawers which can easily be adjusted for either filing application.

4 Claims, 2 Drawing Sheets

FILE DRAWER RAIL

FIELD OF THE INVENTION

The present invention relates to file drawers, and in particular, relates to file drawers having a top rail which is adjustable to accommodate both A4 and letter size file hangers.

BACKGROUND OF THE INVENTION

Most file drawer systems are designed to receive a series of file folder jackets which are used to suspend a file folder. The file folder jackets have laterally extending tabs which engage rails either side of the file drawer. In this way, each file is individually supported and is movable by sliding the file folder jacket along the rails.

File drawers are designed to receive legal size file folders, metric (A4) size folders, or letter size folders. The metric folder is slightly larger than the letter size folder. Unfortunately the variation between A4 size folders and letter size folders, requires that the rail for supporting these jackets must be movable to accommodate either the smaller size letter jacket or the larger A4 jacket. There have been some attempts to have a common support structure to receive letter size or metric size folder jackets.

In some existing file drawer systems, the rails for supporting the file folder jackets are movable within a slot and secured at either end of the drawer. This arrangement works well but is not convenient to manufacture. Other arrangements such as U.S. Pat. No. 5,393,136 define a removable structure having two different hanging positions offset relative to a center securement location and the rail is reversible. The structure is not immediately apparent to an end user how it can be adjusted to accommodate different sizes and the end user may not even realize it is capable of adapting to different sizes.

There remains a need for a more effective structure to accommodate A4 and letter size file jackets.

SUMMARY OF THE INVENTION

A file drawer, according to the present invention, has two opposed parallel top edges appropriately spaced for supporting letter size or metric size file hangers therebetween. Each top edge of the file drawer has a pivoting rail extending in a longitudinal direction of the respective top edge. Each pivoting rail is movable inwardly of the respective top edge to define a space for receiving and supporting a letter size file hanger. The rails are also movable outwardly to define a space therebetween for receiving and supporting a metric A4 size file hanger. With this arrangement, the user merely moves the rails to the appropriate location for the required file folder size.

According to an aspect of the invention, each pivoting rail in cross section, includes a slot like recess opening onto a divided securing cavity. The divided securing cavity has two sections with a cam member therebetween. The cam member, in combination with a securing edge of the rail, provides a bias urging the top edge of the file drawer into one of the two sections.

According to yet a further aspect of the invention, each top rail is an extruded plastic component.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
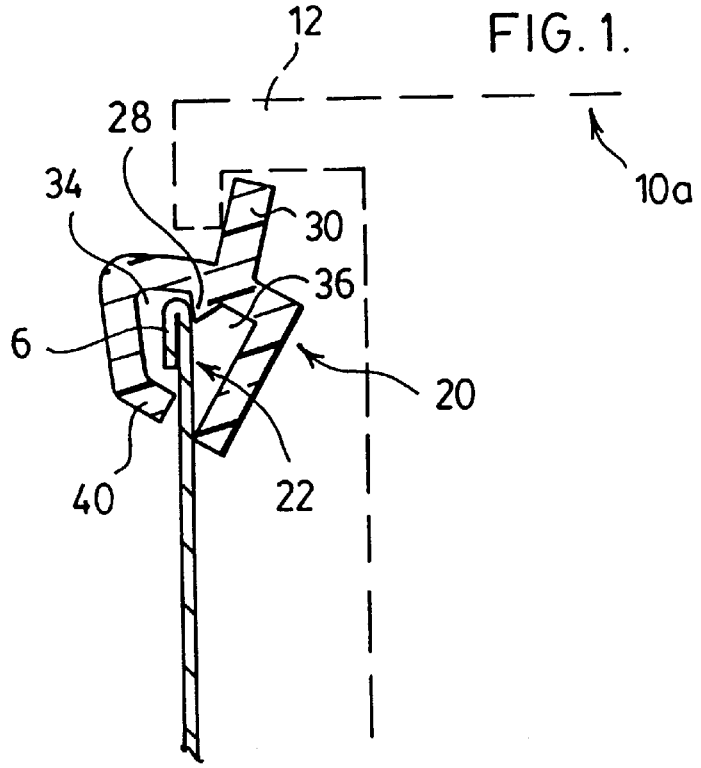
FIG. 1 is a end view showing a securing rail on the edge of a letter file drawer.

The file drawer generally indicated as 2 has opposed top edges 4, with each top edge having a thickened edge portion 6. The adapter support rail 20 has a downwardly opening slot like recess 24 which is forced over the top edge 4 of the rail. The thickened portion 6 of the file drawer is captured within the cavity 22 of the adapter rail 20. The downwardly directed cam member 28 longitudinally divides the cavity 22 into a first locating cavity 34 and a second locating cavity 36. As can be seen in FIG. 1, the thickened portion 6 is captured by the lower edge of leg 40 and the cam member 28.

The letter size file hanger 10*a* of FIG. 1 is shown with its support tab 12 placed on the angled flange 30 of the adapter rail 20.

The file drawer 2 is thus suitable for receiving A4 file jackets or letter size file jackets without modification of the drawer. For example, the rail 20 can be set for the most common position for the particular market. In North America, the rail 20 would be set to the letter size position shown in FIG. 1. The same cabinet could be destined for the European market and the adapter rail 20 would be set to the position of FIG. 2. In this position, the thickened portion 6 of the top edge 4 of the file drawer 2 is located in the second locating cavity 36. The leg 40 in combination with the cam 28, maintains the rail in the set position. The user, if necessary, merely pushes the angled flange 30 to the desired position, forcing the thickened portion 6 of the drawer into the opposite locating cavity. The rail is maintained either in the position of FIG. 1 or in the position of FIG. 2.

Figure 2:
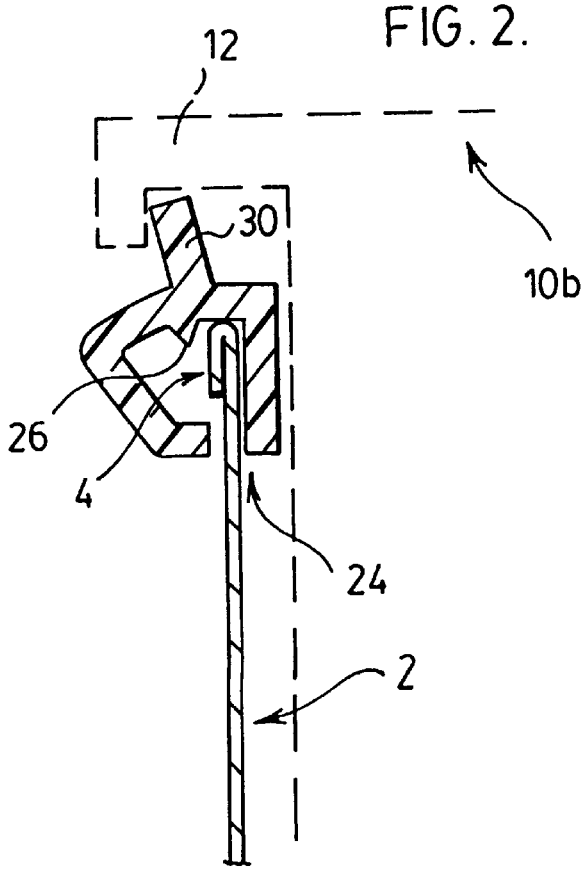
FIG. 2 is a view similar to FIG. 1 with the rail position for receiving a metric A4 file hanger.
Figure 3:
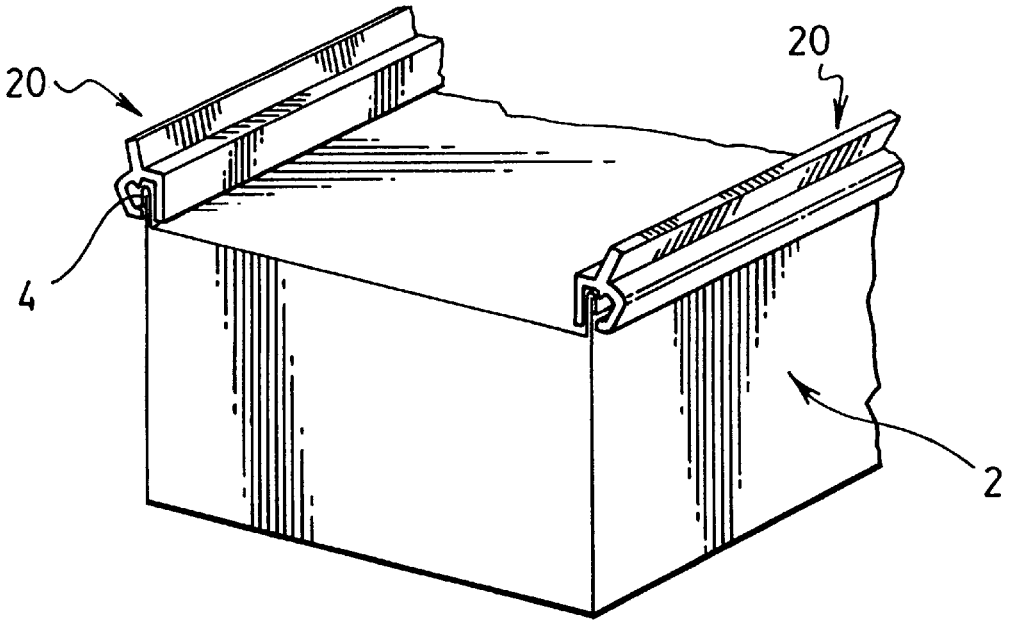
FIG. 3 is a partial perspective view of the rail alone.

FIG. 2 illustrates how the angled flange 30 in a position for receiving A4 file jackets is located outwardly of the file drawer 2, and the support tab 12 of the A4 hanging folder is appropriately located on the adapter rail 20. It can be seen that both the adapter rail 20 and the support tab 12 of the metric file hanger are slightly outside the periphery of the file drawer 2. These file drawers 2 typically include telescopic slide members or other slide arrangements to the outside of the file drawer and as such, the supporting cabinet associated with the file drawer 2 has sufficient clearance to allow the adapter rail 20 to be clear of the interior walls of the cabinet.

It is general human nature to try to make a simple adjustment when something does not fit. The user, when faced with a file drawer positioned according to FIG. 1, may recognize that the top rail has a unique configuration and will attempt to force the angled rail 30 outwardly. This motion will result in the rail by camming past cam 28 to locate the thickened portion of the file drawer 2 as shown in FIG. 2. In addition, the slight angle of the flange 30 in either position will suggest the adjustability of the structure.

With the present invention, it has been found that the securing cavity of the adapter rail 20 can be shaped to accommodate a pivoting movement of the adapter rail about the upper edge of the file drawer 2. The user is not required to remove the adapter rail 20 and the structure of the adapter rail 20 provides a visual suggestion that some adjustable movement of the rail is likely. Note that the two positions of the angled flange are non perpendicular. A distinct camming action biasing the member to one of the two positions provides further confirmation that adjustment is part of the design.

Figure 4:
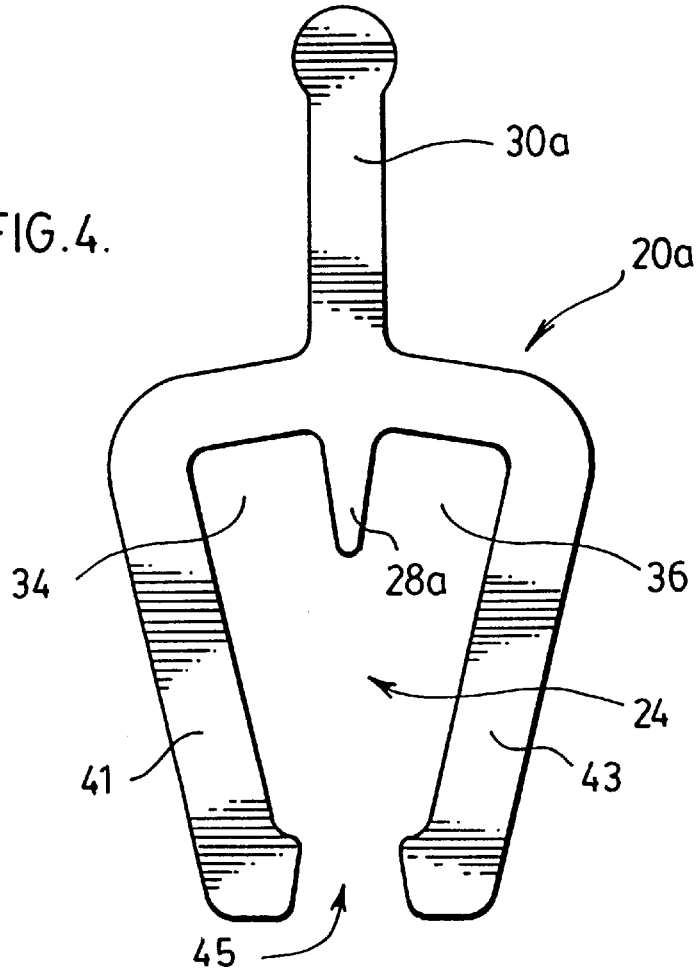
FIG. 4 is an end view of a securing rail of an alternate section.

The securing rail 20*a* of FIG. 4 is movable to one of two positions as described with respect to rail 20, however, a larger dividing member 28*a* separates the first locating cavity 34 from the second locating cavity 36. The rail is now symmetrical and the legs 41 and 43 are longer, and terminate at the retaining slot 45. In this embodiment, the retaining slot is positioned to allow upward movement of the rail to have divider 28*a* clear the top of the top edge 4 of the file drawer, and to relocate the top edge in the desired locating cavity 34 or 36. The securing rail 28 a is retained on the top edge of the file drawer during any repositioning of the flange 30*a* to accept A4 or letter size file jackets.

The adapter rail 20 is preferrably a plastic extrusion which has more than sufficient structural integrity to support the file hangers and the contents of any files placed in the file hangers. There is excellent support for the rail as the top edge of the file drawer is closely associated with the location of the angled rail 30.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A file drawer having two opposed parallel top edges appropriately spaced for supporting file hangers therebetween, said top edges each having a support rail extending in the direction of the respective top edge, wherein each support rail is movable to position a support flange inwardly of said respective top edge to define between said support flanges, a space for receiving and supporting a letter size file hanger, and each support rail is movable to position said support flange outwardly of said respective top edge to define a space between said support flanges for receiving and supporting an A4 file hanger, wherein each top edge has a thickened top portion and each support rail includes a slot which can be forced over said thickened top portion to locate and maintain said thickened portion in a securing cavity of said support rail, and wherein said securing cavity is divided into two sections separated by a downwardly extending cam member which serves to locate said thickened portion in one of said sections on opposite sides of said cam member.

2. A file drawer as claimed in claim 1 wherein each support rail is an extruded component.

3. A file drawer as claimed in claim 2 wherein each support rail is a plastic component.

4. A file drawer as claimed in claim 1 wherein sides of said file drawer are made of sheet metal and said top edges are a rolled edge of said sheet metal.

* * * * *